United States Patent [19]

Nitto et al.

[11] 4,310,403

[45] Jan. 12, 1982

[54] APPARATUS FOR ELECTROLYTICALLY TREATING A METAL STRIP

[75] Inventors: Hajime Nitto, Tokyo; Kango Sakai, Kitakyusyu; Yasuo Shimokawa, Fukuoka; Katusi Saito, Kitakyusyu, all of Japan

[73] Assignee: Nippon Steel Corporation, Tokyo, Japan

[21] Appl. No.: 239,478

[22] Filed: Mar. 2, 1981

[30] Foreign Application Priority Data

Mar. 7, 1980 [JP] Japan ..... 55-28025
Mar. 7, 1980 [JP] Japan ..... 55-28026

[51] Int. Cl.[3] ..... C25D 7/06; C25D 17/10

[52] U.S. Cl. ..... 204/206; 204/28; 204/234; 204/284

[58] Field of Search ..... 204/206, 222, 225, 232, 204/234, 279, 281, 284, 297, 27, 212, 224 R, 28, 15

[56] References Cited

U.S. PATENT DOCUMENTS 3,334,028 8/1967 Polichette ..... 204/224 R X
4,102,772 7/1978 Nakamura et al. ..... 204/206
4,119,514 10/1978 Whittle ..... 204/206
4,119,516 10/1978 Yamaguchi ..... 204/206 X
4,132,609 1/1979 Bush et al. ..... 204/206 X
4,162,952 7/1979 Tribout ..... 204/224 R
4,163,704 8/1979 Murata ..... 204/206
4,183,799 1/1980 Sellitto et al. ..... 204/206

*Primary Examiner*—Arthur C. Prescott
*Attorney, Agent, or Firm*—Wenderoth, Lind & Ponack

[57] ABSTRACT

A metal strip is electrolytically treated by using an apparatus having:

a vessel for defining an electrolytic treatment space for a metal strip;

a plurality of conductor rolls arranged along a path of movement of the metal strip extending through the treatment space;

at least one pair of electrode pads, each pair of electrode pads being located between two conductor rolls and being spaced from and facing each other with the path of movement of the steel strip therebetween, and each pad being provided with at least one slit through which an electrolyte is ejected toward the surface of the metal strip under conditions adquate for creating a static pressure of the ejected electrolyte sufficiently high for holding the metal strip in its path in the gap between the electrode pad and the metal strip, and;

a voltage supply for applying voltage between at least one of the conductor rolls and the electrode pads.

15 Claims, 23 Drawing Figures

APPARATUS FOR ELECTROLYTICALLY TREATING A METAL STRIP

FIELD OF THE INVENTION

The present invention relates to an apparatus for electrolytically treating a metal strip with an electrolyte. More particularly, the present invention relates to a highly efficient apparatus for electrolytically treating a metal strip with an electrolyte and which is provided with an electrode pad capable of applying static pressure to the strip.

BACKGROUND OF THE INVENTION

Generally, it is well known that the surface of a steel strip can be plated with zinc or tin by subjecting the strip to an electrolytic treatment. In such electrolytic treatment, a vertical electrolytic apparatus is usually used. In this apparatus, a steel strip is caused to pass through an electrolytic vessel filled with an electrolyte via rubber rolls submerged in the electrolyte and conductor rolls positioned above the surface of the electrolyte. During the passage through the electrolyte, the strip is electroplated by applying a voltage between the strip as a cathode and an electrode plate as an anode which is suspended in the electrolyte in such a manner that its surface faces a surface of the strip.

However, the conventional electrolytic apparatus is designed on the basis of the concept that the strip is caused to be immersed in the electrolyte. Accordingly, it has the following disadvantages from an operational point of view:

(1) In the case where the apparatus is stopped due to any trouble and the electrolyte must be removed from the vessel, the removal of the electrolyte requires a long period of time, which results in a considerable delay before resumption of the operation, because the vessel is filled with a large amount of the electrolyte.

(2) The strip receives an electric current from the conductor roll positioned above the surface of the electrolyte. In this case, because the roll submerged in the electrolyte should be a non-conductive roll, i.e. an insulating roll such as a rubber roll, a current is supplied to the strip from one direction only. Therefore, the strip extending between the adjacent two conductor rolls around the insulating roll exhibits a high electrical resistance which causes a large consumption of electric power. This is undesirable from the viewpoint of achieving a reduction in energy consumption. Also, because a current is supplied to the strip passing between the electrode plates from one direction only, it is necessary to slope the electrode plates with respect to the strip in order to obtain a uniform distribution of current in the electrolyte involved.

(3) In the immersion electrolysis, while a current is not be supplied, a reverse potential due to a difference in standard electrode potential is created between the insoluble electrode and the material to be plated and between the insoluble electrode and the plating metal. As a result, a potential inversion occurs and the anode acts as a cathode, while the cathode acts as an anode. Accordingly, even in the case where an insoluble electrode material is used for the electrode plate, the useful life of the resultant electrode plate is not significantly long.

(4) The path of movement of the strip may fluctuate due to vibration or twist occurring in the strip between the upper roll and the lower roll as well as the non-uniform shape and C-shaped warp of the strip itself in the transverse direction thereof. Therefore, it is impossible to dispose the electrode plates so as to be very close to the strip. In the conventional electrolytic apparatus, the distance between the surface of the electrode plate and the surface of the strip should be in a range of about 30 to 60 mm. Such a large distance results in the use of a high voltage for electrolysis. This is disadvantageous from the viewpoint of a reduction in energy consumption. Also, it is impossible to carry out a high current density electrolysis.

(5) The portion of the electrolyte contained in the space between the electrode plates is not satisfactorily circulated to the other portion of the electrolyte. As a result, the efficiency of electrolysis deteriorates. Also, when the current density is increased, the quality of the resultant plated layer inevitably becomes inferior.

Japanese Patent Application Publication No. 52—23985(1977) discloses another type of electrolytic apparatus. In accordance with this apparatus, the plating is carried out at the place where the strip faces a direction-converting roll immersed in the electrolyte. This apparatus is characterized by the fact that the strip is guided out of contact with the roll under the action of a fluid cushion which is provided by the electrolyte injected through holes in the surface of the roll and at the same time, the roll is caused to act as an anode.

However, in this electrolytic apparatus, the plating is also carried out while keeping the strip immersed in the electrolyte. Accordingly, this apparatus gives rise to the same problems as those described for the above described conventional apparatus. Moreover, because only one surface of the strip which faces the surface of the immersed roll is plated in this electrolytic apparatus, when both surfaces of the strip are to be plated, the plating must be carried out after reversing the plated surface of the strip in the second of two apparatuses as described above. For this reason, the electrolytic apparatus inevitably becomes large in size.

In addition, in this electrolytic apparatus, the strip is caused to travel out of contact with the roll by ejecting the electrolyte onto only one surface of the strip through the holes provided in the surface of the roll, thereby maintaining a certain distance between the surface of the strip and the surface of the roll. While the strip is caused to travel along the roll, the distance between the surface of the strip and the surface of the roll always fluctuates depending on the change in the tension of the strip. As a result, it is difficult to obatin a uniform deposition of the plating metal on the strip.

SUMMARY OF THE INVENTION

An object of the present invention is to overcome the above described disadvantages of the conventional electrolytic treatment apparatus for a metal strip at a stroke and to provide an electrolytic apparatus suitable for use in treating a metal strip wherein an electrolysis can be carried out at a high efficiency at a high current density while keeping the strip close to the opposed electrode.

Another object of the present invention is to provide an electrolytic treatment apparatus for a metal strip, exhibiting an excellent operating efficiency wherein any trouble occurring during the process can be easily eliminated by stopping the line for a very short period of time.

Still another object of the present invention is to provide an electrolytic treatment apparatus for a metal strip wherein static pressure is applied to the strip by means of an electrolyte ejecting means so as to prevent the vibration, twist, C warp and offset of the strip.

A further object of the present invention is to provide an electrolytic treatment apparatus for a metal strip suitable for use in treating the strip wherein the electric resistance of the strip can be reduced to an extremely low level which can not be attained by the conventional electrolytic apparatus and the electrolytic treatment can be easily carried out at a high current density with stability.

A still further object of the present invention is to provide an electrolytic treatment apparatus for a metal strip wherein a single surface plating or a differential two surface plating in which the thickness of the metal deposited on the front surface of the strip is different from that of the metal deposited on the back surface thereof can be easily carried out.

Another object of the present invention is to provide an electrolytic treatment apparatus for a metal strip wherein the overcoat of the plated metal on the edge portions of the strip can be prevented in order to obtain a uniform deposition of the plating metal on the strip.

Still another object of the present invention is to provide an electrolytic treatment apparatus for a metal strip wherein any deposit on the conductor roll can be easily removed.

A further object of the present invention is to provide an electrolytic treatment apparatus for a metal strip wherein the useful life of the electrode is extended.

A still further object of the present invention is to provide an electrolytic treatment apparatus for a metal strip wherein a multipurpose electrolysis such as a combination of two or more surface treatments, for example, degreasing, pickling, electroplating and formation, can be effected.

The above mentioned objects can be achieved in accordance with the present invention by providing an electrolytic apparatus which comprises:

- a vessel for defining an electrolytic treatment space for a metal strip;
- a plurality of conductor rolls arranged along a path of movement of said metal strip extending through said treatment space;
- at least one pair of electrode pads, each pair of electrode pads being located between two said conductor rolls and being spaced from and facing each other with said movement of path of said steel strip, therebetween and each pad being provided with at least one slit through which an electrolyte is ejected toward the surface of said metal strip under conditions adequate for creating a static pressure of said ejected electrolyte sufficiently high for holding said metal strip in its path of movement in the gap between said electrode pad and said metal strip;
- means for supplying said electrolyte to each electrode pad, and;
- means for applying a voltage between at least one of said conductor rolls and said electrode pads.

DETAILED DESCRIPTION OF THE INVENTION

The electrolytic apparatus according to the present invention is characterized in that the strip is hold in the electrolytic treatment space in the vessel without immersing it in the electrolyte and the strip held in the treatment space is subjected to an electrolytic treatment by ejecting the electrolyte toward the surface of the strip from the electrode pad which may also function so as to create a static pressure in the gap between the electrode pad and the strip, and is disposed at a predetermined position within the electrolytic treatment space so as to face said surface of the strip. Accordingly, the electrolytic treatment space of the electrolytic apparatus according to the present invention is entirely different from that the conventional electrolytic apparatus. That is, in the electrolytic apparatus of the present invention, the electrolytic vessel is not filled with the electrolyte and the electrode pad has a hollow box construction and static pressure is caused to develop between the pad and the strip by ejecting the electrolyte toward the strip through the nozzle of the pad. Accordingly, the electrolytic apparatus of the present invention eliminates various disadvantages encountered in the immersion type electrolytic apparatus. For example, in the case of a vertical electrolytic vessel, even the lower roll can be used as a conductor roll, and in addition thereto, the strip can stably move while vibration of the strip is prevented and distortion of the strip is corrected. In addition, the electrolytic apparatus of the present invention is advantageous in that because the electrolytic vessel is not filled with the electrolyte, the repairing of the conductor roll, such as removal of a deposit from the surface of the roll, can be easily carried out by providing an ejecting port capable of ejecting an electrolyte toward the surface of the conductor roll which is out of contact with the strip.

The apparatus of the present invention will be illustrated in detail in connection with the following embodiment shown in the accompanying drawings.

Figure 1:
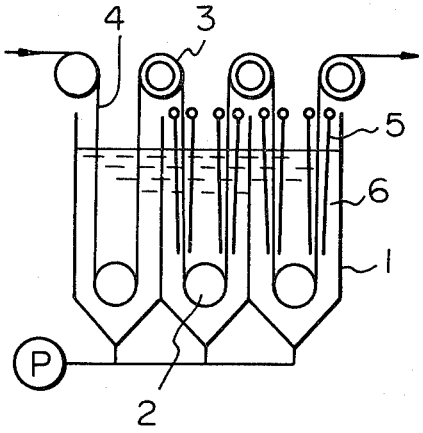
Fig. 1 PRIOR ART
FIG. 1 is a cross-sectional view of the conventional electrolytic apparatus.

In FIG. 1 which shows a conventional apparatus for electrolytically treating a metal strip with an electrolyte, an electrolytic vessel 1 is filled with an electrolyte 6 and a steel strip 4 moves through the electrolytic vessel 4 via rubber rolls 2 submerged in the electrolyte 6 and conductor rolls 3 located above the surface of the electrolyte 6. During the passage through the electrolyte 6, the strip 4 is electroplated or electrodescaled by applying a voltage between the strip 4 as a cathode and an electrode plate 5 as an anode which is suspended in the electrolyte 6 so that the surface of the electrode plate 5 faces a surface of the strip 4.

Figure 2:
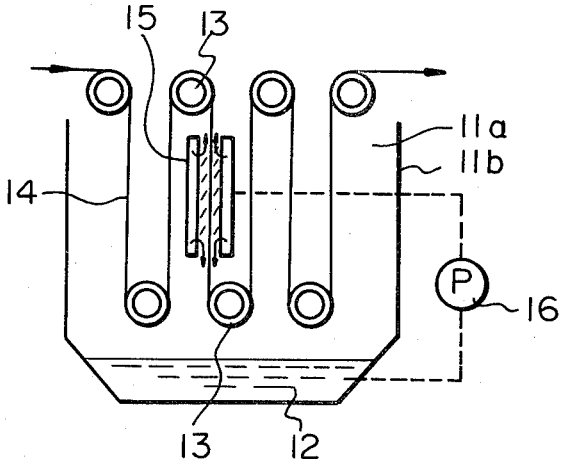
FIG. 2 is a cross-sectional view of an embodiment of the electrolytic apparatus of the present invention.

Referring to FIG. 2, there is schematically shown one embodiment of an electrolytic treatment apparatus of the present invention. In FIG. 2, an electrolytic treatment space 11*a* is defined by a box type electrolytic vessel 11*b* which has a liquid pool 12 provided at the bottom thereof, a plurality of conductor rolls 13 for guiding a metal strip 14 and supplying a current thereto and a pair of electrode pads 15. The conductor rolls 13 are disposed at the upper and lower positions within the treatment space 11*a*. A metal strip 14 is caused to travel along a predetermined up and down zigzag path extending through the treatment space 11*a* and around the conductor rolls 13. The electrode pads 15 are disposed so as to be close to the strip 14 passing between the upper and lower conductor rolls 13 and to be approximately symmetric with respect to the strip 14. The electrode pads 15 are designed so that they can eject an electrolyte toward the strip 14 from the surface thereof facing the strip 14. The electrolyte is supplied at a predetermined pressure into the electrode pad 15 by means of a pump 16, as is shown in FIG. 2. After being ejected, the electrolyte flows downward into the liquid pool 12 from which the electrolyte is circulated into the electrode pad 15 via the pump 16. The electrolyte to be recycled may be conveniently pooled and heated in front of the pump 16. In FIG. 2, only one pair of electrode pads 15 is illustrated. However, in a practical electrolytic apparatus, another one or more pairs of electrode pads may be located along the path of the strip between the other upper and lower conductor rolls 13 within the vessel 11*b*.

Figure 3:
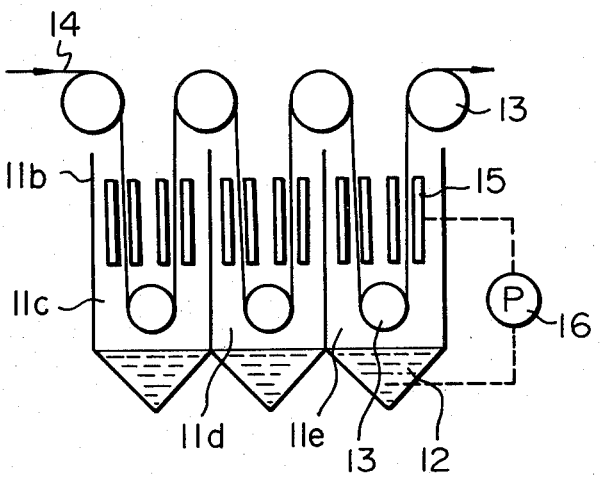
FIGS. 3, 4 and 5 each are cross-sectional views of other embodiments of the electrolytic apparatus of the present invention.
Figure 4:
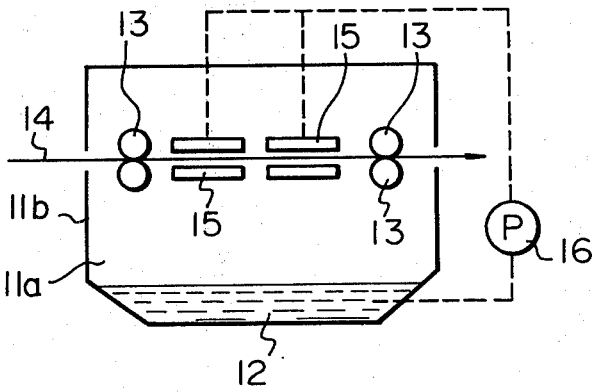
Figure 5:
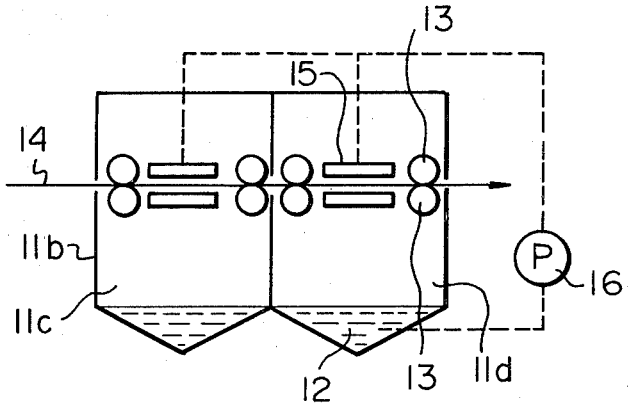

FIGS. 3, 4 and 5 each are a schematic view of further embodiments of the electrolytic treatment apparatus according to the present invention. FIG. 3 shows the same type of vertical electrolytic apparatus as that shown in FIG. 1. In this apparatus, the treatment vessel 11*b* is divided into two or more sections, so that the treatment space in the vessel is divided into two or more sections 11*c*, 11*d*, 11*e*. . . . In the embodiment shown in FIG. 4, the strip 14 is caused to travel horizontally through the treatment space 11*a* in the vessel 11*b*. A plurality of electrode pads 15 are disposed along the path of movement of the strip 14. In the embodiment shown in FIG. 5, the strip 14 is also caused to travel horizontally through the treatment space in the vessel 11*b*. However, in this case, the treatment space is divided into two sections 11*c* and 11*d*.

Figure 6:
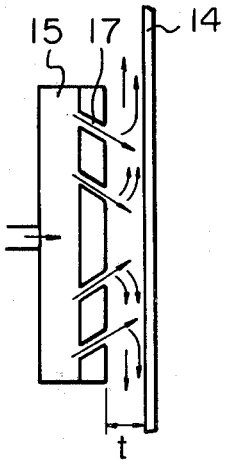
FIG. 6 is a view illustrating the action of the electrode pad of the present invention.
Figure 7:
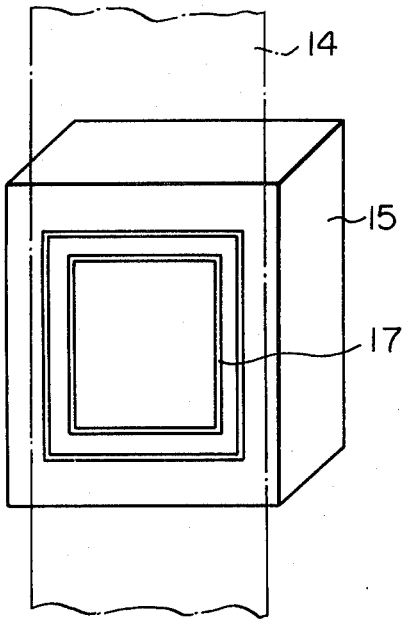
FIG. 7 is a perspective view of the electrode pad of the present invention.

FIG. 6 shows the details of an electrode pad 15 usable for the present invention. The electrode pad 15 is, as a whole, a hollow box shape, and faces the strip 14 substantially parallel thereto and spaced therefrom a required distance of t. The electrode pad 15 has a plurality of electrolyte-ejecting slits 17 bored in its front surface facing the strip 14. In each pair of the pads, each pair of slits 17 facing each other are formed at a symmetric angle to each other. Also, the slits 17 are disposed so as to face the strip 14 as is shown in FIG. 7. When the electrolyte is supplied into the electrode pad 15 at the back side thereof and ejected toward the strip 14 through the slits 17, the electrolyte flows in the directions shown by the arrows as shown in FIG. 6, so that static pressure is created between the front surface of the pad 15 and the surface of the strip 14 facing the pad 15. Because each one of the pair of the electrode pads 15 faces the strip 14, static pressure is applied to both sides of the strip 14. Under the action of the static pressure, the strip 14 is stably supported and prevented from vibrating, and further, the shape distortion thereof is corrected.

On the other hand, if the front surface of the electrode pad 15 which faces the strip 14 is designed so that it functions as an electrode, an electrolytic treatment can be applied to the metal slip 14, because the electrolyte fills the space between the electrode pads 15 and the metal strip 14, so that a desired plated metal layer is formed on the surface of the strip. The surface layer of the electrode pad may be composed of an electrolyte-insoluble metallic electrode material such as a lead-tin alloy plate and platinum-clad titanium plate. It is preferable that the surface layer of the electrode pad be composed of a titanium plate plated with a noble metal such as platinum, because such material has a long useful life.

In the apparatus of the present invention, each electrode pad may be provided with at least one pair of slits extending parallel to the longitudinal or lateral direction of the electrode pad. In this case, it is preferable that the number of the slits be at least two pairs. Also, each electrode pad may be provided with at least one slit extending at an angle to the longitudinal or lateral direction of the electrode pad and at least one slit extending parallel to the longitudinal or lateral direction of the electrode pad.

Figure 8A:
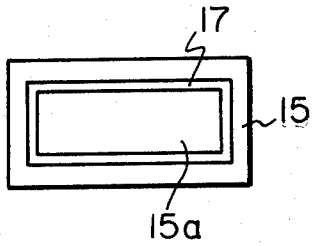
FIGS. 8A through 8E are views illustrating the shapes in the slit of the electrode pad of the present invention respectively.
Figure 8B:
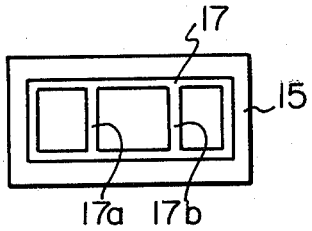
Figure 8C:
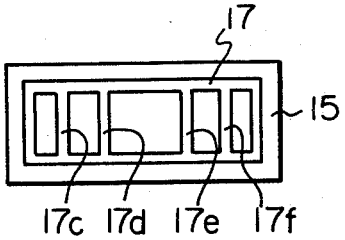

FIGS. 8A through 8D show embodiments of a slit-shaped nozzle of the electrode pad. Referring to FIG. 8A, an electrode pad 15 has a single slit in the form of a rectangle which surrounds the surface of the electrode 15*a*. In the embodiment shown in FIG. 8D, the same type of slit as that shown in FIG. 8A is formed in a multiple form. In the embodiment shown in FIG. 8B, a rectangular slit 17 has two bridging segments 17*a* and 17*b*. In this case, three static pressure zones are created between the electrode pad and the metal strip. In the embodiment shown in FIG. 8C, a rectangular slit 17 has four bridging segments 17*c*, 17*d*, 17*e* and 17*f*, so that five static pressure zones are created between the electrode pad and the metal strip. In the embodiments as shown in FIGS. 8B and 8C, the rectangular slit having one or more bridging segments may be separated into two or more independent slits which are capable of ejecting the electrolyte at a predetermined flow rate and/or pressure of the electrolyte, independently from each other. In the case where the slit has multiple segments, the outermost segment also functions in the capacity of a curtain in order to prevent the electrolyte contained in the space between the electrode pad and the metal strip from engulfing any bubble therein, thereby providing a stable movement of the strip. The provision of multiple bridging segments in the slit is effective when the width of the strip to be treated fluctuates. For example, in FIG. 8C, the slit 17 includes many rectangular segments each suitable for forming a static pressure zone on a metal strip having a width which corresponds to the width of the rectangular segment in the slit 17. That is, the slit indicated in FIG. 8C can be used for various widths of metal strips. That is, the location of the bridging segments can be set depending on the widths of the metal strips to be treated.

Figure 8D:
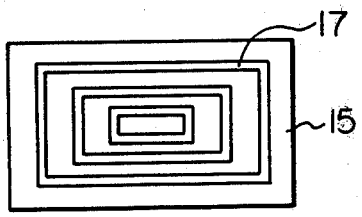
Figure 8E:
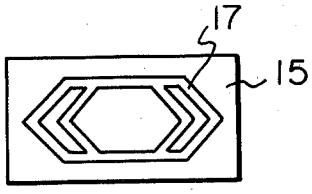

In another embodiment of the slit, the number of slits or segments may be increased to more than the number shown in FIGS. 8C and 8D. Alternatively, the slit may have a shape as shown in FIG. 8E.

Figure 9A:
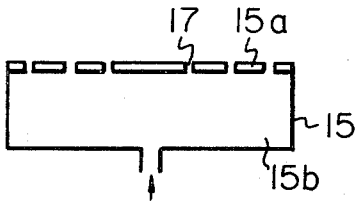
FIGS. 9A through 9C are side cross-sectional views of the electrode pad of the present invention respectively.
Figure 9B:
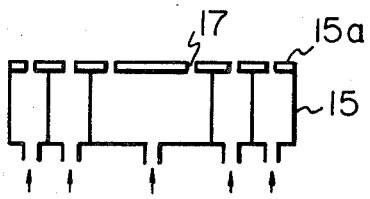
Figure 9C:
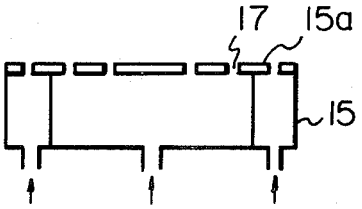

Referring to FIGS. 9A, 9B and 9C, each electrode pad 15 is provided with an electrode surface layer 15*a* and a back box section 15*b*. Also, the box section 15*b* may comprise a plurality of individual compartments corresponding to the number of the slit segments, as shown in FIG. 9B, or any number of compartments, as shown in FIG. 9C. In the case of the box section shown in FIG. 9B or 9C, the pressures and/or flow rates of the electrolyte fed into the respective compartments can be individually controlled. That is, each means for supplying the electrolyte to each of the compartments (that is, each slit segment) may be provided with means for controlling the supply rate and/or pressure of the electrolyte. For example, in the case as indicated in FIG. 8D, each of the three rectangular slits may be independently connected to a separate electrolyte supply means having means for controlling the supply rate and/or pressure of the electrolyte.

It is necessary that all these types of electrode pads should be capable of filling the space between the front surface of the pad and the surface of the strip with the electrolyte and of applying static pressure to the strip by ejecting the electrolyte toward the strip. The type of electrode pad may be conveniently selected depending on the place at which the pad is located and the intended purpose.

In the electrolytic apparatus of the present invention, the distance t between the surface of the strip 14 and the front surface of the electrode pad 15 may be as small as possible. That is because vibration of the strip can be prevented by the static pressure created in the space between the surface of the strip 14 and the front surface of the electrode pad 15. The smaller the distance t, the greater the ability to stably support the strip of the electrolyte. In the apparatus of the present invention, the distance t may be about 10 mm or less.

As described above, the important feature of the electrolytic apparatus of the present invention resides in the fact that at least one pair of the electrode pads capable of applying the static pressure to the strip is disposed along the path of movement of the metal strip so that the front surfaces of the electrode pads face the surface of the strip. The advantages obtained by the use of the electrode pads capable of creating a static pressure will be illustrated in comparison with another type of electrode pad which creates a dynamic pressure on the metal strip.

Figure 10:
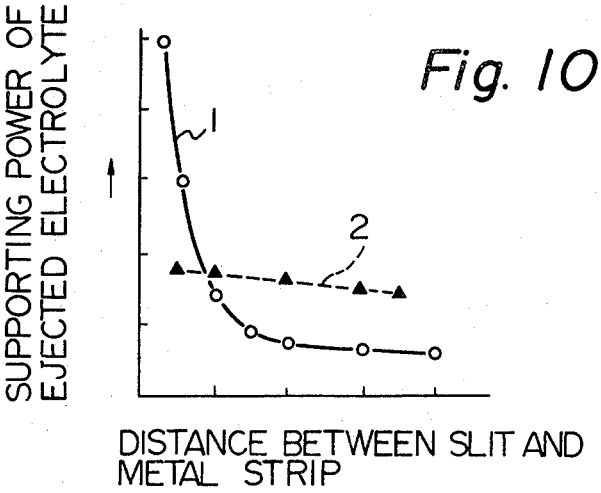
FIG. 10 shows relationships between the distance between the surface of the strip and the surface of the nozzle and the supporting power of the fluid for the static pressure pad and the dynamic pressure pad.

FIG. 10 shows relationship between the distance between a nozzle or slit and the surface of the strip and the supporting ability or power of the ejected electrolyte for a metal strip when the static pressure and dynamic pressure are respectively created on the metal strip.

FIG. 10 clearly indicates that in the case of Curve 2, the supporting power of the ejected electrolyte under a dynamic pressure is almost constant even if the distance between the slit and the surface of the strip is changed, while in the case of Curve 1, the supporting power of the ejected electrolyte under a static pressure varies depending on the distance. That is, in Curve 1, the supporting power becomes larger as the distance is shorter and it becomes smaller as the distance is longer. Accordingly, the static pressure and the dynamic pressure make a great difference in respect to a change in the supporting power or ability with respect to the distance between the slit and the surface of the strip.

Figure 11:
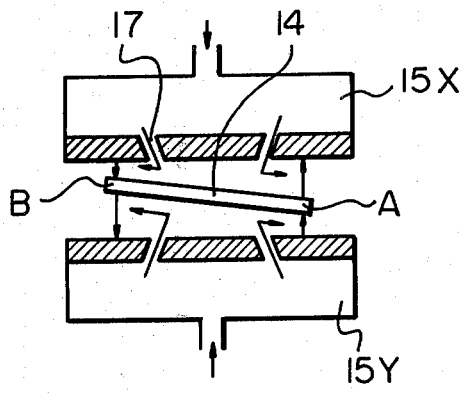
FIG. 11 is a view illustrating the force of restitution applied to the strip when the static pressure pad is used.

Referring to FIG. 11, static pressure type electrode pads 15X and 15Y are disposed so as to face each other while holding the strip 14 therebetween. The electrolyte is ejected toward the strip 14 through the ejecting slits 17 and at the same time, the ejected electrolyte electrolytically treats the metal strip.

In the case where the electrolytic treatment is carried out while ejecting the electrolyte through the slit 17 of the static pressure type electrode pads, disposed as described above, even if the strip 14 shifts from its control position, as shown in FIG. 11, it is repositioned at almost the middle between the pads due to the force of restitution exerted on the strip by the ejected electrolyte. Accordingly, it is possible to stably hold the strip while avoiding contact of the strip with the electrode pads. That is, when the stable mid-position of the strip 14 is changed, as shown in FIG. 11, the distance betwen the surface of the strip 14 and the front surface of the electrode pad 15Y is shorter in the vicinity of the edge A of the strip, while the distance between the surface of the strip 14 and the back surface of the electrode pad 15X is longer in the vicinity of the edge A of the strip. As a result, as previously illustrated with reference to FIG. 10, the supporting ability of the ejected electrolyte due to static pressure is higher on the side of the pad 15Y and lower on the side of the pad 15X. Accordingly, a force in the direction shown by the arrow in FIG. 11 acts on the strip 14, so that the strip 14 is forced back to the middle where the supporting forces from both sides are balanced. On the other hand, for the same reasons, a force in the opposite direction shown by the arrow in FIG. 11 acts on the strip in the vicinity of the edge B of the strip 14, so that the strip is held in the middle between both pads.

As described above, in the case of the static pressure type electrode pad, the force of restitution due to static pressure action is exerted on the strip, so that the strip can be stably held in the middle between the electrode pads. As a result, the distance between the surface of the electrode pad and the surface of the strip can be reduced, which makes it possible to reduce the electrolytic voltage and to supply a high electric current to the strip. In addition, the use of the static pressure type electrode pad is advantageous in that both surfaces of the strip can be simultaneously electrolytically treated.

In contrast, when the dynamic pressure type electrode pad is used, the holding force of the ejecting electrolyte for the strip is almost constant, even if the distance between the surface of the strip and the surface of the nozzle is varied. Therefore, even if the strip changes position and is inclined toward one of a pair of pads, the strip can not be returned to the original position because no force of restitution is exerted on the strip. Accordingly, if the position of the strip is to be corrected by using the dynamic pressure type electrode pad, it is necessary to control the ejection pressure of the electrolyte at individual positions of the electrode pad. However, it is practically impossible to stably hold the strip in the middle between a pair of electrode pads by dynamic pressure only.

A process in which the strip is electrolytically treated by using the dynamic pressure type electrode pads as the electrode pads, is disclosed in Japanese Patent Publication No. 53-18167(1978) and Japanese Patent Application Laid-open Publication No. 54-138831(1976), both of which belong to the applicant of the present application, and Japanese Patent Application Publication No. 52-133839(1977) which belongs to another applicant. Japanese Patent Application Publication No. 53-18167 discloses that both surfaces of the strip can be plated. However, because this process has the disadvantages described above for the dynamic pressure type electrode pads, it has not yet been put to practical use. On the other hand, Japanese Patent Application Laid-open Publication No. 54-138831 and 52-133839 relate to a process or apparatus by which only one surface of the strip can be plated by ejecting the electrolyte toward the surface through a dynamic pressure pad.

The present invention overcomes the above described disadvantages of by the dynamic pressure type electrode pads. The greatest feature of the electrolytic apparatus according to the present invention is the use of the static pressure type electrode pad. Due to such a feature, the strip can be stably held between the electrode pads as described previously.

The action of the force of restitution resulting from the use of the static pressure type electrode pads will be illustrated hereunder.

Figure 12:
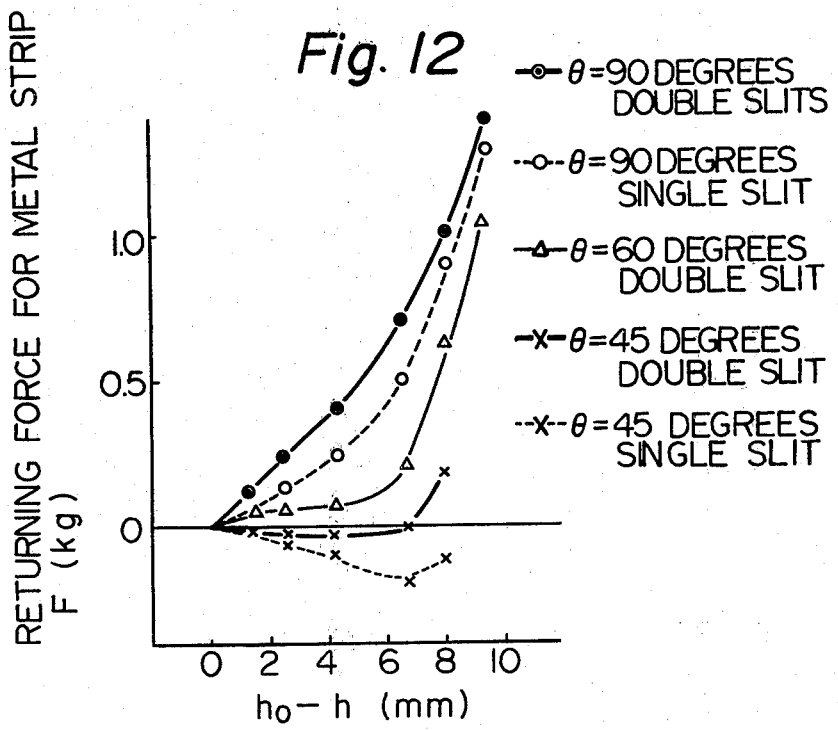
FIG. 12 is a graph of data concerning the force of restitution applied to the strip when the static pressure pad is used.
Figure 13A:
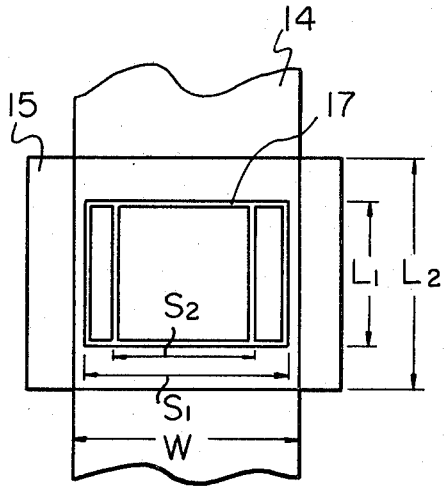
FIGS. 13A and 13B are views illustrating a method of determining the force of restitution.
Figure 13B:
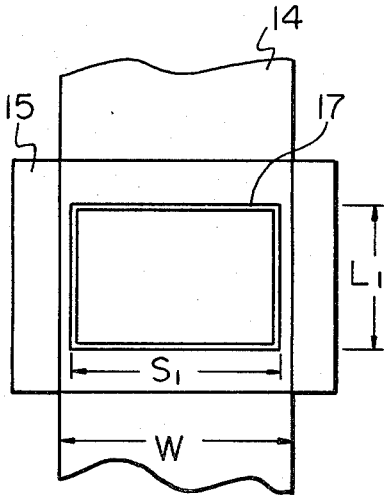
Figure 13B:
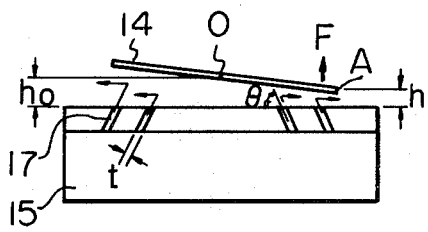
Figure 13B:
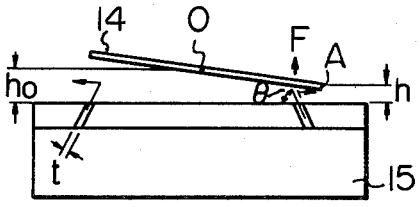

FIG. 12 is a graph of data concerning the force of restitution obtained when the static pressure type electrode pads having electrolyte-ejecting slits shown in FIG. 13A and 13B, respectively, are used. More particularly, a pair of static pressure type electrode pads having electrolyte-ejecting slits shown in FIGS. 13A and 13B, respectively, and in which the slits are at angles $\theta$ of 45°, 60° and 90°, respectively, with respect to the front surface of the electrode pads and a thickness t of, for example, 2.5 mm, are disposed so as to face each other with the strip 14 therebetween. The strip 14 is freely rotatable around its middle point, i.e. a point O, the distance between the middle point O and the front surface of the electrode pad 17 is represented by $h_0$, and the distance between an edge point A of the strip 4 and the front surface of the electrode pad 17 is represented by h. The difference ($h_0$-h), indicates the difference between the distance $h_0$ from the front surface of the electrode pad to the middle point O of the strip and the distance h from the front surface of the electrode pad to the edge A of the strip.

In the slits as shown in FIGS. 13A and 13B, the dimensions of the slits are, for example, as follows:

$S_1$=450 mm, $S_2$=300 mm, $L_1$=300 mm and $L_2$=480 mm which is a width of the electrode pad 15. These slits are usable for a metal strip having a width W of about 500 mm. In FIG. 12, the supporting force exerted on the strip in the vicinity of the edge A thereof is plotted against the difference ($h_0$-h).

FIG. 12 indicates that the supporting force provided by the electrolyte ejected from the static pressure type electrode pad is greatly influenced by the angle at which the electrolyte is ejected through the slit of the pad. That is, the highest supporting force is obtained when the slit has an angle of 90° to the front surface of the electrode pad. The next highest supporting power is obtained when the slit is inclined inwardly at an angle of 60 degrees or 120 degrees to the front surface of the electrode pad. When the slit is inclined inwardly at an angle of 45 degrees or 135 degrees to the surface of the electrode pad, a small force which is not enough for supporting the strip, is obtained.

Consequently, it is preferable that the static pressure type electrode pad be provided with slits capable of ejecting the electrolyte inwardly at an angle of from 60 to 120 degrees to the front surface of the electrode pad. This result was confirmed by carrying out a pilot line test. Also, with regard to the configuration of the slit, a double slit is better than a single slit.

The electrolytic apparatus having the above described construction according to the present invention is applicable to not only a strip making a straight advance almost vertically, but also to a strip making an almost straight advance while being inclined at a certain angle or to a strip making a straight advance horizontally. In the latter cases, the front surface of the electrode pad is disposed almost parallel to the surface of the strip.

The operation of the electrolytic apparatus of the present invention will be illustrated again with reference to the apparatus shown in FIG. 2.

The strip 14, after being subjected to a pre-treatment, is introduced into the electrolytic vessel 11*b* and then, caused to travel through the vessel 11 along a predetermined path via the upper and lower conductor rolls 13 which are disposed on both sides of the electrode pads 15 in the direction of travel of the strip. If the strip 14 can be charged with a high electric current by any other means, one of the upper and lower conductor rolls may be used as a conductor, while the other conductor roll may be replaced with a non-conductive roll such as a rubber roll. One or more pairs of electrode pads are disposed in the inner space 11*a* of the electrolytic vessel 11*b* through which the strip 14 moves along a predetermined path. The front surface of each electrode pad faces the other and the surface of the strip held by the conductor rolls. When the strip 14 is subjected to an electrolytic treatment, an electric current flows across the strip 14 and the front surface of the electrode pad 15 disposed at a predetermined position in such a manner that the strip 14 and the pad surface act as a cathode and an anode, respectively, while ejecting the electrolyte onto the surface of the strip 14 through the slits 17 of the electrode pad 15. The strip 14 is charged with an electric current through the conductor roll 13. When the electrolyte is ejected, the gap between the surface of the strip 14 and the front surface of the electrode pads 15 is filled with the ejected electrolyte. Then, the strip 14 is subjected to an electrolytic treatment, so that a desired metal is deposited on the surfaces of the strip 14 or the surface of the strip 14 is electrolytically descaled. In the case of the electroplating treatment, by repeating such an electrolytic treatment, a desired thickness of the deposit is formed on the surfaces of the strip 14. Thereafter, the plated strip 14 leaves the treatment space 11*a* and is then delivered to the subsequent process.

The electrolyte is supplied at a required pressure into the electrode pads 15 by means of the pump 16, and ejected at a certain flow rate through the slits 17 of the electrode pads, so as to reach the surfaces of the strip 14.

After the ejected electrolyte has performed its function, it falls down to the bottom of the vessel 11*b* and is then pooled in the liquid pool 12. The electrolyte pooled in the pool 12 is again supplied into the pump 16, from which it is recycled into the electrode pads 15.

In the above described electrolytic treatment, the strip 14 is electrolytically treated with the electrolyte ejected through the slits 17 of the electrode pads 15 located at predetermined necessary locations, while being held in the treatment space. Accordingly, the strip 14 can be effectively prevented from being vibrated under the action of the static pressure of the electrolyte having a large mass. For example, if the electrolyte is ejected toward the strip immersed in a liquid phase, the flow speed of the ejected electrolyte is reduced because of the resistance of the liquid, which causes the ejected electrolyte to exhibit a low static pressure. In contrast, because the ejection of the electrolyte is carried out in an air atmosphere in accordance with the present invention, reduction in the flow speed of the ejected electrolyte is very slight and as a result of this, the ejected electrolyte exhibits a high static pressure. In addition, because the ejected electrolyte flows at a high flow speed through the gap between the strip 14 and the electrode pad 15, the space is always filled with fresh electrolyte. Moreover, a satisfactory supply and diffusion of ions in the electrolyte takes place in the gap, which makes it possible to increase the current density. A high current density is effective for increasing the efficiency of the electrolytic treatment. By way of example, the conventional electrolytic apparatus has used a current density of from 20 to 30 $A/dm^2$. In the electrolytic apparatus of the present invention, a current density of 150 $A/dm^2$ or more can be used. In addition, because the static pressure can be created in the gap between the electrode pad 15 and the strip 14, stable travel of the strip 14 along its path of movement in the gap is attained, which makes it possible to reduce the distance between the front surface of the electrode pad 15 and the surface of the strip 14. The reduction of the distance allows the use of a reduced electrolytic voltage, which leads to a reduction in consumption of energy.

Also, because the strip 14 is caused to travel through the electrolytic treatment space while being held in the space without immersing it in the electrolyte, in the case of the vertical electrolytic vessel, the guide rolls for the strip positioned in the upper and lower portions of the vessel 11*b* may be used as conductor rolls. That is, although the lower roll must be an insulating roll in the conventional vertical electrolytic apparatus, these rolls may also be used as conductor rolls in the electrolytic vessel of the present invention. For this reason, the strip 14 can be charged with a high current and the resistance of the strip 14 can be reduced to $\frac{1}{3}$ or less, as compared with that encountered in the conventional vertical electrolytic apparatus. Also, because the strip 14 is charged with an electric current by means of the upper and lower conductor rolls, the electrode pad 15 need not be inclined with respect to the strip 14 and, instead thereof, the pad 15 can be positioned substantially parallel to the strip 14. As a result of this, a uniform current density in the strip 14 can be obtained throughout the electrolytic treatment.

Even in the case of the horizontal electrolytic apparatus, as shown in FIGS. 4 and 5, all of the holding rolls 13 at both sides of the electrode pads 15 which are disposed along the up and down zigzag path of the strip 14, can be used as conductor rolls, and, therefore, the same advantages described for the vertical electrolytic apparatus can be obtained.

Moreover, in accordance with the electrolytic apparatus of the present invention, because the strip 14 is caused to travel through the electrolytic treatment space while being held in the space without immersing it in the electrolyte, a further advantage can be obtained.

In the electroplating of the strip, the strip metal, intermetallic compounds and other materials are deposited on the surface of the conductor roll during the electrolytic treatment. If these deposits are not removed from the conductor roll, various problems inevitably arise, such as an increased electrical resistance between the strip 14 and the conductor roll 13, an increased voltage between the electrode pads, an arc spot formed on the surface of the strip and scratches formed on the plated surface of the strip.

Figure 14:
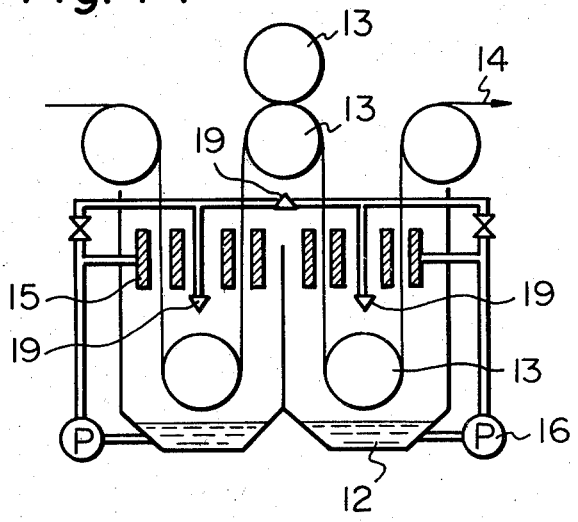
FIG. 14 is a cross-sectional view of the electrolytic apparatus provided with a means for removing a deposit on the conductor roll according to the present invention.

In the conventional electrolytic apparatus, these deposits are removed by grinding the rolls using a mechanical grinding device provided on the surface of the conductor roll. Referring to FIG. 14, this type of mechanical grinding device is usually provided on the surface of the additional conductor roll 13' contacting the upper surface of the strip. This is because the mechanical grinding device is relatively large-size and it is, therefore, difficult to dispose it in a narrow space under the conductor roll 13 contacting the lower surface of the strip, as shown in FIG. 14. However, the mechanical removal of the deposits on the surface of the conductor roll is accompanied by the disadvantages that there is a great possibility of damaging the surface of the expensive conductor roll; continuous operating capability is poor because of clogging of the abraisive; complete removal of the deposits does not place and the efficiency of the removal operation is inferior.

On the contrary, in the apparatus of the present invention, the above described disadvantages can be overcome by providing a means capable of ejecting an electrolyte against a portion of the peripheral surface of the conductor roll located downstream of at least one pair of the electrode pads, which portion is out of contact with the strip. That is, as shown in FIG. 14, while the electrolytic treatment is going on or while it is temporarily suspended, same electrolyte as that used for the electrolytic treatment, or a liquid having the same composition as that of the electrolyte, is ejected through a nozzle 19 toward a portion of the surface of each conductor roll 13, which portion is out of contact with the strip 14, whereby the deposits on the surface of the conductor rolls are continuously removed mainly due to the chemical dissolution action of the ejected liquid.

The removal means through which the electrolyte is ejected, such as an ejection nozzle, is simpler and more compact than the existing mechanical grinding device. Accordingly, such a compact removal means can be provided in places where the conventional grinding device is not usable, for example, a narrow place below the upper conductor roll, or above the lower conductor roll of the vertical electrolytic apparatus.

In the case where the electrolyte ejecting means is used, because the deposits on the surface of the conductor roll can be effectively removed without damaging the surface of the conductor roll, the conductor roll can be continuously used over a long period of time without the necessity of replacing it with a fresh conductor roll.

Accordingly, this type of means is very useful for practical operates.

The efficiency of deposit removal can be enhanced by utilizing a physical action, i.e. a high ejection pressure, in combination with the chemical dissolution action. It is preferable, therefore, that the electrolyte be ejected at a high pressure. Also, by ejecting the electrolyte having incorporated therein air, an oxygen-containing gas, oxygen-rich air or pure oxygen, the chemical dissolution action can be enhanced.

Moreover, in accordance with the electrolyte apparatus of the present invention, plating of one surface of the strip and a differential two surface plating wherein the thicknesses of the coatings deposited on the two surfaces are different from each other, can be easily and conveniently carried out. That is, when the strip 14 is subjected to electrolytic treatment by feeding the electrolyte into one of the electrode pads 15 disposed so as to be symmetric with respect to the strip 14, as shown in FIG. 2, while feeding a gas, such as air, into the other pad, the electrolytic plating treatment takes place only between the electrode pad ejecting the electrolyte and the surface of the strip toward which the electrolyte is ejected. As a result of this, only this surface is plated and the other surface remains non-plated. In this case, because the fluids (the electrolyte and air) are also ejected toward both surfaces of the strip 14, the strip 14 receives static pressure from both sides, so that it is supported by the static pressure. In this case, the ejection pressure should be controlled on at least one side of the strip, so as to balance the static pressures on both sides of the strip. This process of one surface plating is also effective for keeping the non-plated surface clean because the electrolyte is prevented from going round to the non-plated surface by means of the ejection of a gas, such as air.

Figure 15:
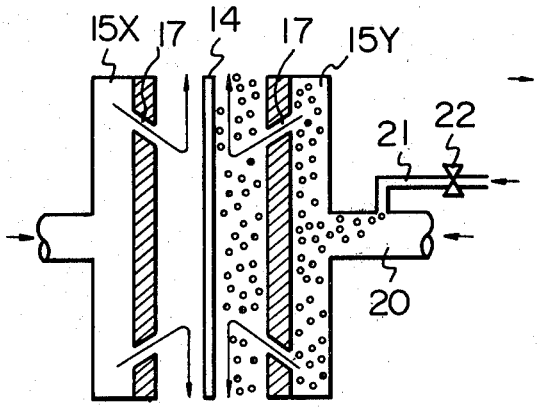
FIG. 15 is a view illustrating the practice of one surface plating and a differential two surface plating by means of the static pressure electrode pad of the present invention.

In addition, the one surface plating may also be carried out as follows. Referring to FIG. 15, the electrolyte is fed into only one electrode pad 15X of a pair of electrode pads disposed so as to be symmetric with respect to the strip 14, while the electrolyte containing a large amount of gas bubbles is fed into the other pad 15Y. The gas-containing electrolyte is obtained by introducing the gas into an electrolyte feed pipe 20 through a gas feed pipe 21 connected to the pipe 20, as shown in FIG. 15. Then, a current is supplied to only the electrode pad 15X into which only the electrolyte is fed. As a result of this, only one surface of the strip receiving the electrolyte is plated while protecting the other surface of the strip from being plated.

The electrode pads shown in FIG. 15 may also be used for carrying out differential two surface plating wherein the respective thickness of deposits on both surfaces of the strip are controlled.

It is well known that when the electrolyte contains bubbles, the electrical conductivity thereof is reduced. Taking advantage of this principle, a current is supplied to both electrode pads while controlling the amount of the gas incorporated into the electrolyte in the electrode pad 15Y by means of a control valve 22. In this manner, the thickness of the metal deposited on the surface of the strip facing the electrode pad 15Y can be optionally controlled. When it is desired that the respective thicknesses of the deposits on both surfaces of the strip be differet from each other, depending on the intended use, this can be easily attained by incorporating a required amount of gas into the electrolyte of only one electrode pad.

Moreover, by taking advantage of the fact that when the electrolyte contains bubbles, the electrical conductivity thereof is reduced, an edge overcoat of the plating metal can be prevented, thereby forming a uniform deposit on the surface of the strip.

It is well known in an electroplating procedure that a greater quantity of electricity flows through the edge of a strip facing an electrode and, as a result of this, the amount of a deposited metal on the edge portion of the surface of the strip is larger than that deposited on the central portion of the surface thereof in the lateral direction of the strip. This phenomenon is called an edge overcoat. In accordance with the present invention, such an edge overcoat can also be prevented.

Figure 16:
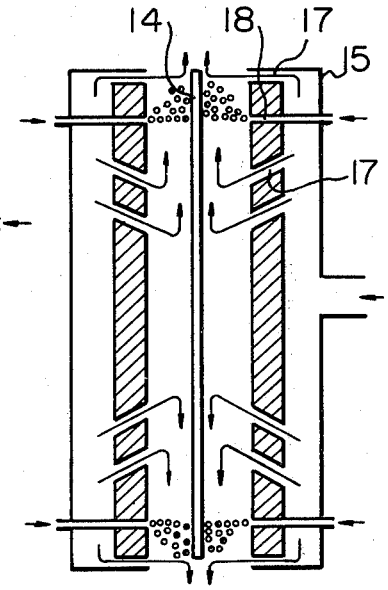
FIG. 16 is a view illustrating the prevention of an edge overcoat by means of the static pressure electrode pad of the present invention.

That is, referring to FIG. 16, in the electrode pads 15 disposed so as to be symmetric with respect to the strip 14, in addition to the electrolyte-ejecting slit 17, gas ejecting ports 18 are provided on the edges in the lateral direction of the electrode pads so as to face the edges of the strip 14. Then the electrolyte is ejected toward the strip 14 through the slit 17 and at the same time, a gas is ejected toward the edge portions of the strip 14 through the ports 18 to form a gas-liquid mixture which is then brought into contact with the edge portions of the strip 14. As a result of this, the electrical conductivity between the edge portions of the surface of the strip and the corresponding portions of the surface of the electrode pads is reduced. Accordingly, by controlling the amount of the gas fed, it is possible to adjust the amount of deposited metal on the edge portion of the strip to a desired level and to obtain a uniform amount of deposited metal on the strip in the lateral direction thereof.

Even in the case where one surface plating or differential two surface plating is effected in the manner as described above with reference to FIG. 15, the edge overcoat can be prevented by providing the gas ejecting ports on the edges of the electrode pads facing the edges of the strip in the lateral direction thereof.

The greater the diameter of the bubbles included in the electrolyte, the lower the electrical conductivity of the electrolyte involved. Therefore, in order to obtain a certain degree of conductivity, it is necessary that the bubbles have a small diameter. The diameter of the bubbles is usually 1 mm or less, preferably, 100 $\mu$m or less.

If any trouble arises while the electrolytic procedure is being carried out by using the electrolytic apparatus of the present invention, the supply of the electrolyte to the electrode pad is immediately suspended. On suspension of the electrolyte supply, the electrolyte contained in the gap between the electrode pad and the strip flows downward. Accordingly, where occurs no destruction of the passivation oxide film on the surface of the electrode pad due to a potential reversal generated when the supply of current is stopped, which phenomenon is encountered in the conventional immersion type of electrolysis. Therefore, as described above, by making the electrode surface insoluble in the electrolyte, it is possible to extend the useful life of the resultant electrode to a remarkable extent. Also, if the electrode pad is suitably supported in such a manner that it can be freely moved in the lateral direction and the direction at a right angle to the surface of the strip, it can be immediately transferred to a shelter when the supply of the current is stopped. The repair of the electrode pad or the replacement of the used electrode pad with a fresh electrode pad can also be carried out easily. In addition, the distance between the pair of electrode pads can be optionally adjusted.

A multipurpose electrolytic treatment can be effected by arranging the sections of the electrolytic apparatus of the present invention in series. For example, the electrolytic vessel may be divided into two or more sections, for example, three sections as shown in FIG. 3. With the construction shown in FIG. 3, an electrolytic degreasing can be carried out in the first section A, a water washing or hot water washing can be carried out in the second section B, and an electrolytic pickling can be carried out in the third section C. When an additional section is provided in the vessel, an electrolytic plating can be carried out in the additional section (not shown). That is, various surface treatments, such as a combination of pickling, plating and other chemical treatment or a combination of degreasing, water washing and other chemical treatment can be applied to the strip.

In addition, a high current electrolytic treatment is possible in the electrolytic apparatus of the present invention. Accordingly, the number of electrolytic vessels can be substantially reduced, as compared with the number of the vessels in the conventional electrolytic apparatus. Whether single purpose electrolysis or multipurpose electrolysis is carried out in electrolytic processes such as electroplating, the electrolytic apparatus of the present invention can be assembled in a compact style, thereby reducing the length of the electrolytic apparatus line to a substantial degree.

As described above, the electrolytic apparatus of the present invention is based on the concept that the strip is held in space and subjected to an electrolytic treatment at only the specified place of the space. The concept of the present invention is entirely different from the conventional concept of electrolytic treatment. Accordingly, in accordance with the electrolytic apparatus of the present invention, almost all of the disadvantages of the immersion type of the conventional electrolytic apparatus can be eliminated. Particularly, because the supply of an electrolyte at a high flow speed is possible, the efficiency of electrolytic treatment is enhanced and a high current density electrolytic treatment is possible.

A more important thing is that the electrode pad used in the present invention serves not only as an electrode, but also as a static pressure pad preventing vibration of the strip. This feature is effective for positioning the electrode pad closer to the strip. Coupled with a reduction in the electrical resistance of the strip due to the utilization of all the rolls as conductor rolls, this close positioning greatly contributes to a saving in power costs. Also, the electrolytic apparatus of the present invention is advantageous in that its maintenance is very easy.

From the foregoing, it is apparent that the electrolytic apparatus of the present invention is highly valuable from both operational and industrial points of view.

We claim:

1. An apparatus for electrolytically treating a metal strip with an electrolyte, which comprises:

a vessel for defining an electrolytic treatment space for a metal strip;

a plurality of conductor rolls arranged along a path of movement of said metal strip extending through said treatment space;

at least one pair of electrode pads, each pair of electrode pads being located between two said conductor rolls and being spaced from and facing each other with said path of said steel strip therebetween, and each pad being provided with at least one slit through which an electrolyte is ejected toward the surface of said metal strip under conditions adquate for creating a static pressure of said ejected electrolyte sufficiently high for holding said metal strip in its path in the gap between said electrode pad and said metal strip;

means for supplying said electrolyte to each slit, and;

means for applying voltage between at least one of said conductor rolls and said electrode pads.

2. The apparatus as claimed in claim 1, wherein said conductor rolls are arranged to form an up and down zigzag type path of movement of said metal strip.

3. The apparatus as claimed in claim 1, wherein said conductor rolls are arranged to form a horizontal path of movement of said metal strip.

4. The apparatus as claimed in claim 1, wherein the ejecting directions of said electrolyte-ejecting slits of said electrode pads are at a angle of from 60 to 120 degrees to the surface of said electrode pads facing said path of movement of said metal strip.

5. The apparatus as claimed in claim 1, wherein the surface layer of each electrode pad facing said path of said metal strip, is composed of movement of metallic electrode material which is insoluble in said electrolyte.

6. The apparatus as claimed in claim 5, wherein said metallic electrode material is a titanium plate plated with a noble metal.

7. The apparatus as claimed in claim 1, which further comprises means for ejecting an electrolyte toward a portion of the peripheral surface of each conductor roll located downstream of at least one pair of said electrode pads which portion is out of contact with said metal strip, to remove undesirable deposits from said peripheral surface of said conductor roll.

8. The apparatus as claimed in claim 1, wherein said treatment space is divided into two or more sections.

9. The apparatus as claimed in claim 1, which further comprises means for introducing bubbles of a gas into said electrolyte to be ejected.

10. The apparatus as claimed in claim 1, which further comprises a pair of nozzles for ejecting a gas toward both edge portions of said metal strip located between a pair of said electrode pads, which nozzles are located in both edge portions of at least one electrode pad.

11. The apparatus as claimed in claim 1, which further comprises means for recycling said electrolyte through said electrode pads and the bottom of said vessel.

12. The apparatus as claimed in claim 1, wherein each electrode pad is provided with at least one pair of slits extending in parallel to the longitudinal or lateral direction of said electrode pad.

13. The apparatus as claimed in claim 12, wherein the number of said slits is at least two pairs.

14. The apparatus as claimed in claim 1, wherein each electrode pad is provided with at least one slit extending at an angle to the longitudinal or lateral direction of said electrode pad and at least one slit extending in parallel to the longitudinal or lateral direction of said electrode pad.

15. The apparatus as claimed in claim 1, wherein each electrolyte-supplying means is provided with means for controlling the supply rate and/or pressure of said electrolyte.

* * * * *